US005855973A

United States Patent [19]

Calvert et al.

[11] Patent Number: 5,855,973

[45] **Date of Patent: *Jan. 5, 1999**

[54] HEAT SEALED, OVENABLE FOOD CARTONS AND LIDS

[75] Inventors: Barry Gene Calvert, Covington, Va.; Jack Ronald Hornsby, Milford, Ohio

[73] Assignee: Westvaco Corporation, New York, N.Y.

[ * ] Notice: The term of this patent shall not extend beyond the expiration date of Pat. No. 5,660,898.

[21] Appl. No.: 918,252

[22] Filed: Aug. 25, 1997

Related U.S. Application Data

[63] Continuation-in-part of Ser. No. 520,130, Aug. 28, 1995, Pat. No. 5,660,898.

[51] Int. Cl.[6] ..... B65D 5/62

[52] U.S. Cl. ..... 428/34.2; 428/34.7; 428/36.4; 428/206; 428/514; 229/5.81; 229/5.84; 426/113; 426/127

[58] Field of Search ..... 428/34.2, 34.7, 428/36.4, 206, 514; 220/458, 462; 229/3.1, 3.5 R, 5.81, 5.84; 426/113, 127

[56] References Cited

U.S. PATENT DOCUMENTS

| | | | |
|---|---|---|---|
| 3,788,876 | 1/1974 | Baker et al. | 229/132 |
| 3,863,832 | 2/1975 | Gordon et al. | 229/125.35 |
| 4,002,801 | 1/1977 | Knechtges et al. | 428/474.9 |
| 4,070,398 | 1/1978 | Lu | 206/524.2 |
| 4,249,978 | 2/1981 | Baker | 156/291 |
| 4,336,166 | 6/1982 | Penczuk et al. | 524/53 |
| 4,438,232 | 3/1984 | Lee | 524/272 |
| 4,469,754 | 9/1984 | Hoh et al. | 428/476.3 |
| 4,522,972 | 6/1985 | Mondt et al. | 524/548 |
| 4,543,280 | 9/1985 | Fujita et al. | 206/524.3 |
| 4,720,405 | 1/1988 | Carson et al. | 427/410 |
| 4,737,309 | 4/1988 | Fricano et al. | 428/34.2 |
| 4,775,560 | 10/1988 | Katsura et al. | 428/34.2 |
| 4,861,821 | 8/1989 | Aubrey et al. | 524/512 |
| 4,900,594 | 2/1990 | Quick et al. | 428/34.2 |
| 4,930,639 | 6/1990 | Rigby | 229/208 |
| 4,956,210 | 9/1990 | Hoyt et al. | 428/35.3 |
| 5,002,833 | 3/1991 | Kinsey, Jr. et al. | 428/475.8 |
| 5,003,004 | 3/1991 | Simms | 525/68 |
| 5,009,939 | 4/1991 | Goldberg | 428/34.2 |
| 5,039,339 | 8/1991 | Phan et al. | 428/481 |
| 5,084,352 | 1/1992 | Percec et al. | 428/412 |
| 5,169,470 | 12/1992 | Goldberg | 156/244.14 |
| 5,183,706 | 2/1993 | Bekele | 428/349 |
| 5,217,159 | 6/1993 | Calvert et al. | 229/136 |
| 5,234,159 | 8/1993 | Lorence et al. | 229/125.35 |
| 5,266,406 | 11/1993 | Hartog et al. | 428/423.1 |
| 5,418,008 | 5/1995 | Calvert | 427/203 |
| 5,425,972 | 6/1995 | Calvert | 428/34.2 |
| 5,458,723 | 10/1995 | Watkins et al. | 456/310 |
| 5,494,716 | 2/1996 | Seung et al. | 428/34.2 |
| 5,498,452 | 3/1996 | Powers | 428/34.2 |

FOREIGN PATENT DOCUMENTS

| | | |
|---|---|---|
| 213233 | 3/1994 | Germany . |
| 264189 | 3/1990 | Japan . |
| 3234800 | 10/1991 | Japan . |
| 1156597 | 7/1969 | United Kingdom . |
| 2188935 | 1/1987 | United Kingdom . |

*Primary Examiner*—Rena L. Dye
*Attorney, Agent, or Firm*—J. R. McDaniel; R. L. Schmalz

[57] ABSTRACT

This invention relates to paperboard packages or cartons suitable for distributing, marketing and heating prepared food products. Such structures of this type, generally, include a coating which is mass stable below 400° F., has chloroform-soluble extractives not exceeding 0.5 mg/in.$^2$ of a food contact surface when exposed to a food simulating solvent of 150° F. for two hours and is flexible enough to withstand conventional scoring in a cross-direction with a 2 point male rule and a 0.062 inch channel while sustaining a crack length ratio of no greater than 0.1 and exhibits resistance to blocking when stacked under a load at ambient conditions of 0.5 lbs/sq. in or greater.

10 Claims, 4 Drawing Sheets

HEAT SEALED, OVENABLE FOOD CARTONS AND LIDS

This application is a continuation-in-part of application Ser. No. 08/520,130, filed on Aug. 28, 1995, now U.S. Pat. No. 5,660,898.

BACKGROUND OF THE INVENTION

1. Field of the Invention

This invention relates to paperboard packages or cartons suitable for distributing, marketing and heating prepared food products. Such structures of this type, generally, include a coating which is mass stable below 400° F., has chloroform-soluble extractives not exceeding 0.5 mg/in.$^2$ of a food contact surface when exposed to a food simulating solvent of 150° F. for two hours, is flexible enough to withstand conventional scoring in a cross-direction with a 2 point male rule and 0.062 inch channel while sustaining a crack length ratio of no greater than 0.1 and exhibits resistance to blocking when stacked under a load at ambient conditions of 0.5 lbs/sq. in. or greater.

2. Description of the Related Art

To meet complex purity and performance specifications, highly specialized packaging systems have been developed for distributing, marketing and heating food for service and consumption. Many of these packaging systems are based upon a structural substrate folded from a pre-printed and die-cut bleached sulphate paperboard as described by U.S. Pat. No. 4,249,978 ('978) to T. R. Baker, entitled "Method of Forming A Heat Resistant Carton", U.S. Pat. No. 3,788,876 ('876) to D. R. Baker et al., entitled "Carton Blanks Printed With A Heat Sealable Composition And Method Thereof", and commonly assigned U.S. Pat. No. 4,930,639 ('639) to W. R. Rigby, entitled "Ovenable Food Container With Removal Lid".

To protect the paper package or carton from moisture degradation, due to direct contact with a food substance, the internal surfaces of such a carton are coated with a moisture barrier of one or more continuous films of thermoplastic resin. These films are usually applied to the paperboard web, prior to printing and cutting, as a hot, viscous, extruded curtain. Low density polyethylene (LDPE), polypropylene (PP) and polyethylene terephthalate (PET) are some of the more common thermoplastic resins used for this purpose.

Also, paperboard-based food trays may take one of several forms including a press formed tray, a molded pulp tray, a solid plastic tray or a folded tray. However, trays of the foregoing description require three separate converting operations following the manufacture of the tray web: 1) extrusion of the thermoplastic barrier coating; 2) printing of the sales graphics; and 3) die-cutting of the carton tray blank. Consolidating these operations into a single operation would offer obvious economic advantages. Moreover, relatively high coat weights are required for an extruded moisture barrier (typically from 11 to 26 pounds per 3000 ft.$^2$ of ream) since lighter coat weights usually result in an inconsistent polymer layer thickness or a layer with little or no adhesiveness to the paperboard. Consequently, a more advantageous carton tray, then, would be presented if the thermoplastic barrier could be eliminated while reducing the number of converting operations.

It is apparent from the above that there exists a need in the art for a carton tray and lid which is capable of adequately protecting the food product and avoids the use of the thermoplastic barrier, but which at the same time is capable of being constructed in a single converting operation. It is a purpose of this invention to fulfill this and other needs in the art in a manner more apparent to the skilled artisan once given the following disclosure.

SUMMARY OF THE INVENTION

Generally speaking, this invention fulfills these needs by providing a paperboard food distribution carton, wherein the paperboard carton is consisting essentially of: a paperboard substrate having a first side with a first calendered coating of particulate minerals which provides an outer surface suitable for the printing of graphics and a second side supporting a first continuous coating of a dried, water-based, copolymer emulsion which provides an inner surface suitable for direct food contact, the improvement wherein the dried, water-based, copolymer emulsion further provides barrier properties and heat sealing a paperboard lid to the food distribution vessel in a covering position over a corresponding vessel fill opening, wherein the first dried water-based, copolymer emulsion is further characterized as being mass stable below 400° F., can be tacked bonded at 250° F. or greater, has chloroform-soluble extractives not exceeding 0.5 mg/in.$^2$ of food contact surface when exposed to a food simulating solvent at 150° F. for two hours, is flexible enough to withstand conventional scoring in the cross direction with a 2 point male rule and a 0.062" channel while sustaining a crack length ratio of no greater than 0.1 provides slip and block resistance when stacked under a load of 0.5 lbs/sq. in. or greater, and is applied to the second side at a coat weight of 6 to 12 dry pounds per 3000 sq. ft.

In certain preferred embodiments, the water-based emulsion further can be tack bonded at temperatures of 250° F. or greater and is mass stable below 400° F. Also, the water-based emulsion can be applied at coat weights of between 2.0 to 12 dry pounds/3000 ft.$^2$ ream. Finally, in order to achieve block resistance insoluble particles of a specific size range are added to the coating. The specific gravity of the particles has to be within a certain range which is dependent on the coating solvent. In the preferred embodiment of the present invention the solvent is water. The specific gravity for the particles in a water-based formulation ranges from 0.80 to 3.5. The specific gravity of the insoluble particles must be such that they stay suspended within the coating without excessive agitation. If the specific gravity is too low, the particles will congregate at the surface. If the specific gravity is too high the insoluble particles will settle out of the water-based emulsion.

In another further preferred embodiment, the use of the dried, water-based emulsion increases the flexibility of the tray and the lid such that excessive score cracking is substantially reduced.

The preferred carton, according to this invention, offers the following advantages: lightness in weight; ease of assembly; excellent heat sealability; reduced score cracking; excellent flexibility; good durability; good stability; excellent block resistance; and excellent economy. In fact, in many of the preferred embodiments, these factors of ease of assembly, heat sealability, reduced score cracking, block resistance and flexibility are optimized to the extent that is considerably higher than heretofore achieved in prior, known cartons.

The above and other features of the present invention, which will become more apparent as the description proceeds, are best understood by considering the following detailed description in conjunction with the accompanying drawings, wherein like characters represent like parts throughout the several views and in which:

DETAILED DESCRIPTION OF THE INVENTION

A paperboard substrate of the present invention is, typically, constructed from a 0.018 inch thick solid bleached sulphate (SBS) sheet. Definitively, the term paperboard describes paper within the thickness range of 0.007 to 0.028 inches. The invention is relevant to the full scope of such a range, as applied to packaging and beyond.

When used for food carton stock, paperboard is usually clay coated on at least one side surface and frequently on both sides. The paperboard trade characterizes a paperboard web or sheet that has been clay coated on one side as C1S and C2S for a sheet coated on both sides. Compositionally, this paperboard coating is a fluidized blend of minerals such as coating clay, calcium carbonate, and/or titanium dioxide with starch or an adhesive which is smoothly applied to the traveling web surface. Successive densification and polishing by calendering finishes the mineral coated surface to a high degree of smoothness and a superior graphics print surface.

When C1S paperboard is used for food packaging, the clay coated surface is prepared as the outside surface, i.e., the surface not in contact with the food. Pursuant to the present invention, the other side (the side in contact with the food) is coated with a specialized, water-based emulsion to be further described in greater detail. The emulsion coating process may include a gravure roll, flexocoater, a rod coater, an air knife or a screen blade.

According to the present invention the typical emulsion application rate, for an independent (not connected to the lid), C1S paperboard tray that is to be heat sealed to a food carton lid is in the range of 6 to 12 dry pounds per 3000 $ft.^2$ ream. A C2S food carton tray would require only 2 to 8 dry pounds per 3000 $ft.^2$ ream due to the greater "hold out" of the emulsion moisture barrier coating inherent in a calendered, clay coated paper surface.

Figure 1:
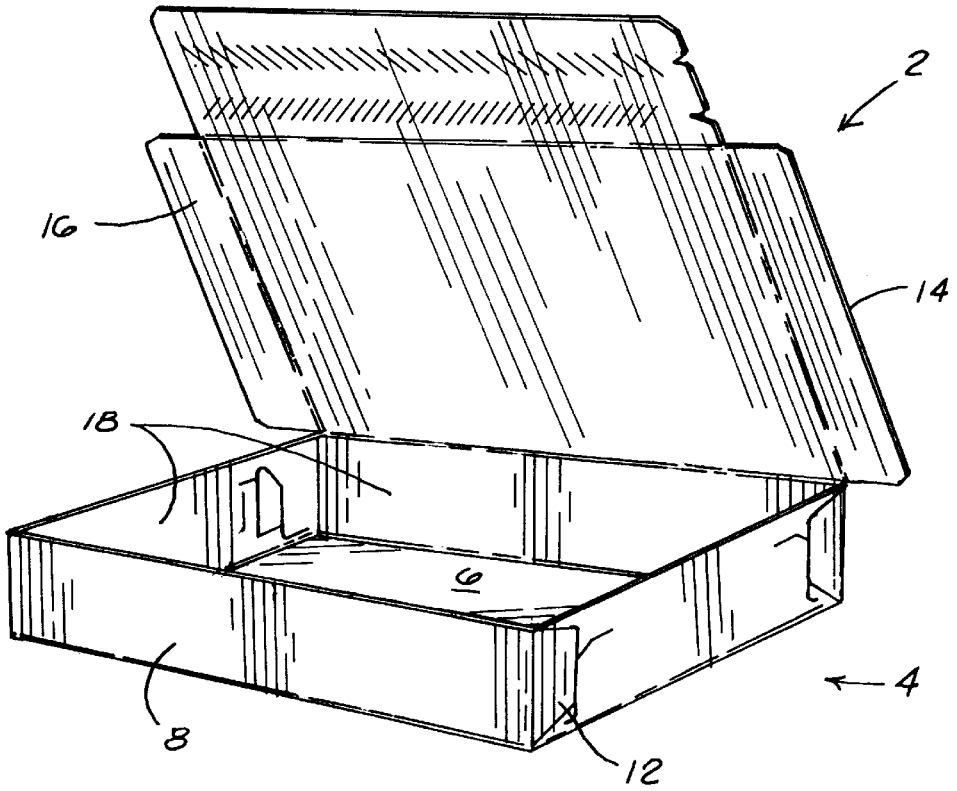
FIG. 1 is a pictorial view of a paperboard food carton having an integral lid closure, according to the present invention.
Figure 5:
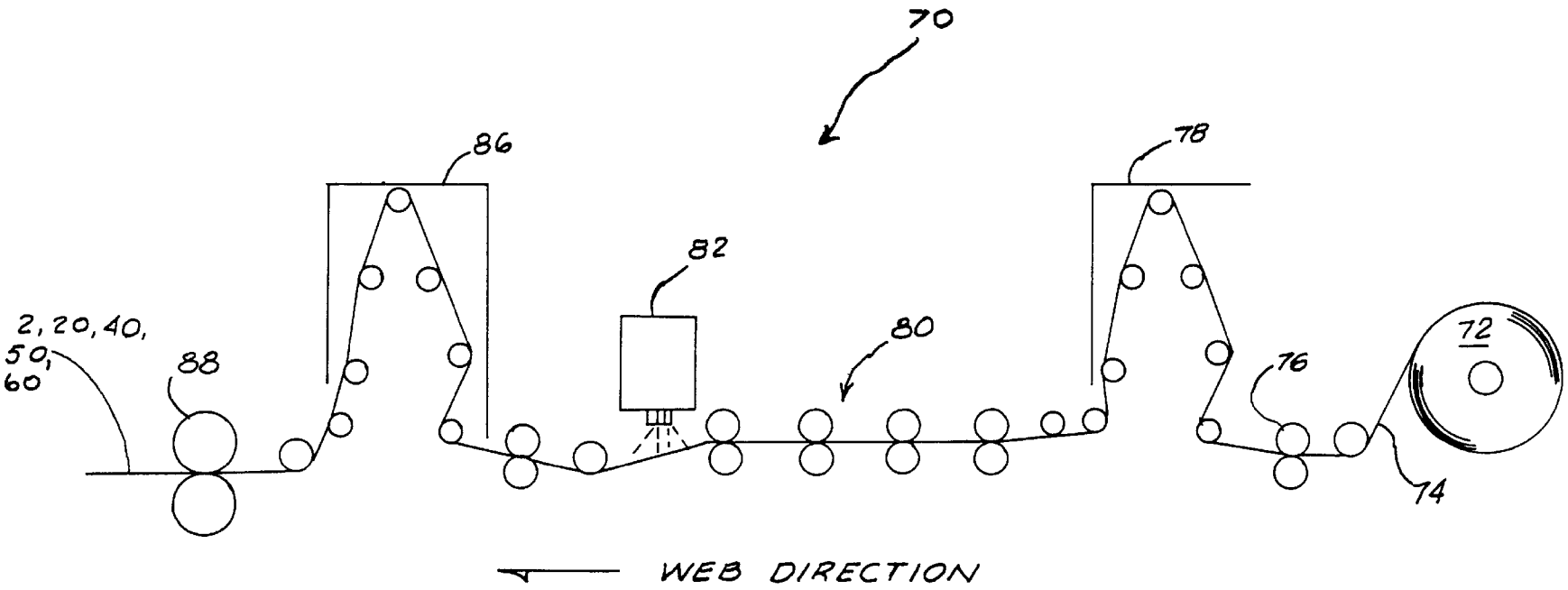
FIG. 5 is a schematic illustration of an apparatus for producing a heat-sealed ovenable food carton tray, according to the present invention.

With reference first to FIG. 1, there is illustrated paperboard food carton 2. Carton 2 includes in part, vessel 4 with integral closure lid 14. The carton 2 components also include bottom panel 6, side walls 8, corner gussets 12, flaps 16 and coating 18. The carton 2 in FIG. 1 is cut from a paperboard sheet or web (FIG. 5) of a great length. From a reel material handling system, in the case of a C1S paperboard web, the water-based emulsion coating 18 is continuously or patterned applied by means of the conventional coating techniques mentioned earlier to the non-clay side of the web at a deposition rate of, preferably, 6 to 12 dry pounds per 3000 sq. ft. ream. When a C2S paperboard is used, the coating 18 is applied to one of the clay-coated surfaces at, preferably, 2 to 8 dry pounds per ream. With respect to FIG. 1, the emulsion coated side of the tray would be the side opposing the internal lid surface. Also, from a reel handling system, the clay coated surface of the web is printed with sales and informational graphics at station 80 (FIG. 5).

In the normal course of events, flat printed blanks to be later formed into the package depicted in FIG. 1 are cut and scored for folding from a sheet or web and delivered to the food processor as stacks of independent articles. The blank is formed via mechanically locking gusset tabs. The paperboard vessel 2 is then filled with food product prior to lid closure and sealing. Lids 14 are typically sealed via flaps 16 being heat sealed to sidewalls 8. Such systems are manufactured by Kliklok Corp. of Atlanta, Ga., Raque Food Systems of Louisville, Ky., and Sprinter Systems of Halmstad, Sweden.

Figure 2:
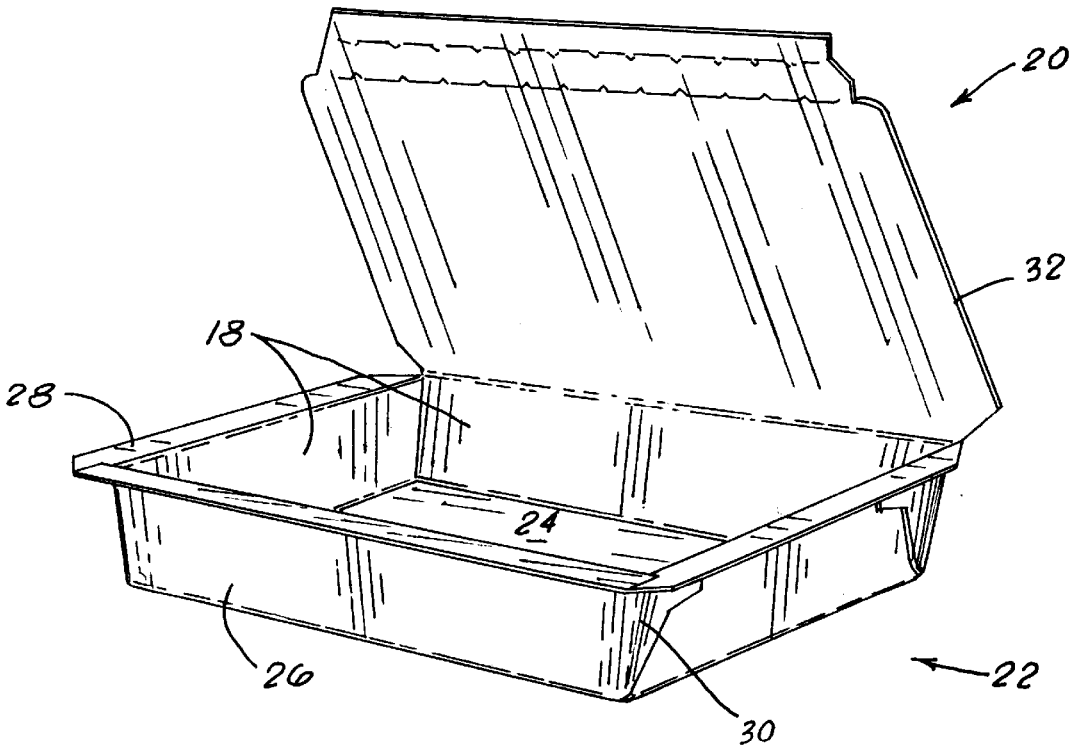
FIG. 2 is a pictorial view of another paperboard food carton having an integral lid closure, according to the present invention.

A second embodiment of the present invention is carton 20 as shown in FIG. 2 which broadly comprises a vessel or a tray 22 with an integral closure lid 32. The carton 20 components also include bottom panel 24, side walls 26, flange 28, corner gussets 30, and coating 18. The carton 2 in FIG. 2 is cut from a paperboard sheet or web (FIG. 5) of a great length. From a reel material handling system, in the case of a C1S paperboard web, the water-based emulsion coating 18 is continuously or patterned applied by means of the conventional coating techniques mentioned earlier to the non-clay side of the web at a deposition rate of, preferably, 6 to 12 dry pounds per ream. When a C2S paperboard is used, the coating 18 is applied to one of the clay-coated surfaces at, preferably, 2 to 8 dry pounds per ream. With respect to FIG. 2, the emulsion coated side of the tray would be the side opposing the internal lid surface. Also, from a reel handling system, the clay coated surface of the web is printed with sales and informational graphics at station(s) 80 (FIG. 5).

Flat blanks to be later formed into the package depicted in FIG. 2 are manufactured and delivered in palletized stacks to the food processor as previously described. The blank is formed via heat sealing of the gussets. The paperboard vessel 22 is then filled with food product prior to lid closure and sealing. Lids 32 are typically sealed via heat sealing of the front flap and side flanges. Manufacturers of such sealing systems are the same as previously listed.

Figure 3:
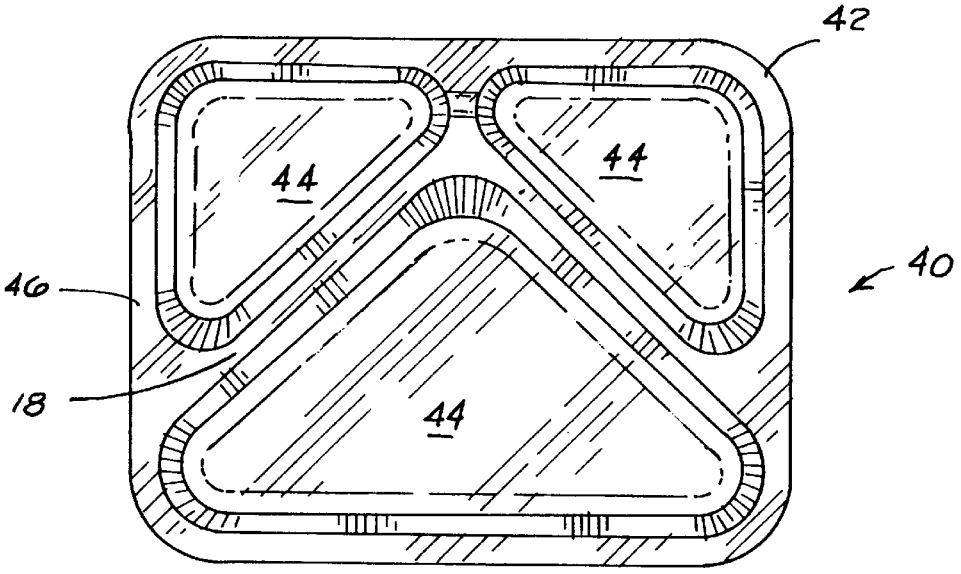
FIG. 3 is a pictorial view of a press-formed paperboard food tray, according to the present invention.

With respect to FIG. 3, tray 40, includes in part, tray compartments 44, flange 46 and coating 18. The tray 40 in FIG. 3 is cut from a paperboard sheet or web (FIG. 5) of a great length. From a reel material handling system, in the case of a C1S paperboard web, the water-based emulsion coating 18 is continuously or patterned applied by means of the conventional coating techniques mentioned earlier to the non-clay side of the web at a deposition rate of, preferably, 6 to 12 dry pounds per ream. When a C2S paperboard is used, the coating is applied to one of the clay coated surfaces, preferably, at 2 to 8 dry pounds per ream. With respect to FIG. 3, the emulsion coated side would be the surface located at coating 18.

Flat blanks to be later formed into the package depicted in FIG. 3 are cut and scored for folding from a sheet or web. The flat blanks are then press formed into the carton. Formed trays are delivered to the customer in stacks for food filling and closing. The closure may be manufactured from coated board material similar to the tray or from film. In either case a conventional heat seal process would be used to attach the closure to the tray flanges. Manufacturers of such sealing systems are the same as previously listed.

Figure 4:
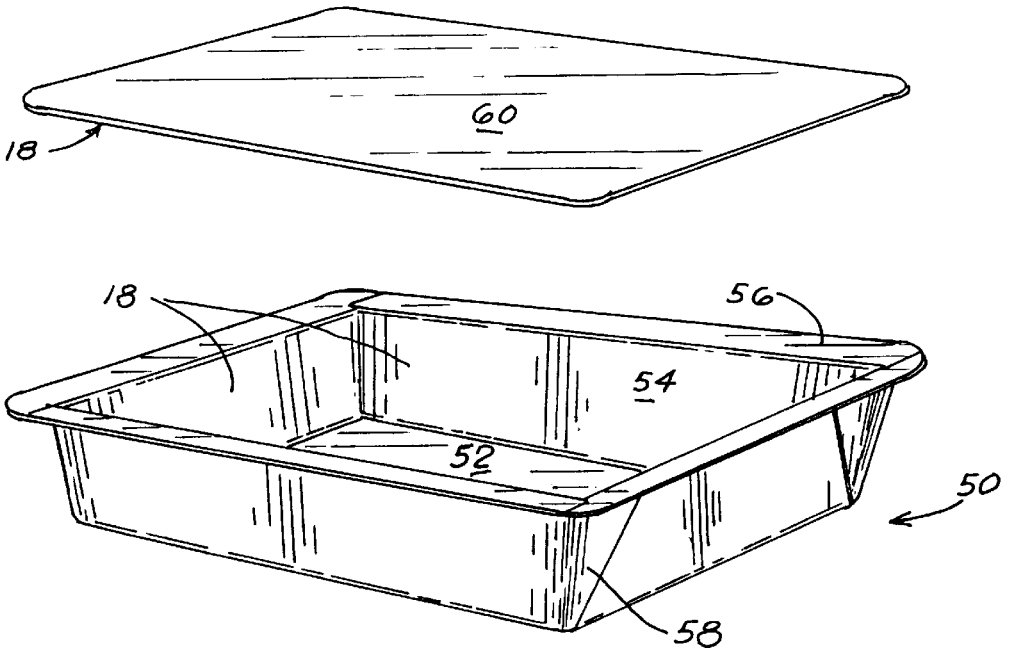
FIG. 4 is a pictorial view of a folded paperboard food tray and lid, according to the present invention.

With respect to FIG. 4, paperboard carton tray 50 and lid 60 are illustrated. Tray 50 includes in part, bottom panel 52, side walls 54, flange 56, corner gussets 58, and coating 18. Tray 50 and lid 60 are cut from a paperboard sheet or web (FIG. 5) of a great length. From a reel material handling system, in the case of a C1S paperboard web, the water-based emulsion coating 18 is continuously or patterned applied by means of the conventional coating techniques mentioned earlier to the non-clay side of the web at a deposition rate of, preferably, 6 to 12 dry pounds per ream. When a C2S paperboard is used, the coating is applied to one of the clay coated surfaces, preferably, at 2 to 8 dry pounds per ream. With respect to FIG. 4, the emulsion coated side would be the surface located at coating 18.

Flat blanks to be later formed into the package depicted in FIG. 4 are manufactured and delivered to the food processor as previously described. The blank is formed via heat sealing of the gussets. The paperboard tray 50 is then filled with food product prior to lid closure and sealing. The closure may be manufactured from coated board material similar to the tray or from film. In either case a conventional heat seal process would be used to attach the closure to the tray flanges. Manufacturers of such sealing systems are the same as previously listed.

As discussed earlier in some detail, FIG. 5 illustrates a self-contained, single-pass apparatus 70 for producing paperboard packaging tray and lid blanks in which the application of the barrier and/or heat seal coating 18 is combined with the printing of the sales graphics eliminating the need for a separate off-line coating operation. This illustration depicts production of paperboard blanks for trays 2, 20, 40 and 50 and lids 60. In particular, apparatus 70 includes, in part, paper roll 72, paper roll web 74, coating apparatus 76, conventional coating dryer 78, printing station (s) 80, curing station 82, coating station 84, conventional coating dryer 86, conventional cutters 88, and paperboard blanks for trays 2, 20, 40 and 50 and lids 60.

During the operation of apparatus 70, paper roll 72 is unrolled such that web 74 is formed. Web 74 is traversed along apparatus 70 by conventional techniques to coating station 76. At the coating station 76, web 74 is coated with the water-based emulsion, according to the present invention, on the non-clay coated side when using a C1S paperboard substrate or a clay coated surface when using a C2S substrate.

Following the application of the water-based emulsion upon web 74, web 74 is traversed to conventional coating dryer 78 where the emulsion is dried according to conventional drying techniques. Following each drying unit, the web 74 is cooled through contact with conventional drum chillers (not shown). Web 74 is traversed to graphic printing stations 80 where graphics such as sales or the like are placed upon web 74 on the side opposite the water-based emulsion. Inks are then cured by curing station 82. Radiation curable inks are preferred due to their graphic appeal, endurance, and end use performance.

FIG. 5 is only a suggested sequence as related to the application of the coating and the printing of graphics. However, in all cases both processes are accomplished in the same basic operation on a single "pass".

Following printing of graphics and application of coating 18 to the back side of the web 74, web 74 is traversed to cutting mechanism 88 which scores and cuts the web into the desired blanks from trays 2, 20, 40 and 50 and lids 60. Rotary cutting systems have proven to be the preferred method, however, other conventional cutting techniques may be employed. Additionally, one may choose to wind the web in roll form or sheet the web for cutting at a later time.

One representative source of the water-based emulsion coating 18, relied upon by the present invention, includes the Michelman tray coat 16 product of Michelman, Inc., Cincinnati, Ohio. The Michelman product is comprised of a heat activated (or sealable) copolymer or a polymer coating with "flexibility" characteristics. Essential properties of this water-based emulsion when used for food contact coatings are: (a) mass stability at temperatures below 400° F., i.e., below 400° F., the coating will not melt, degrade or otherwise lose mass (for instance, by a solvent outgassing); (b) can be tack bonded at temperatures of 250° F. or greater; (c) chloroform-soluble extractives levels do not exceed 0.5 mg/in.$^2$ of food contact surface when exposed to a solvent, for example, N-Heptane at 150° F. for two hours; and (d) is flexible enough to withstand conventional scoring in the cross direction with a 2 point male rule and a 0.62 inch channel while sustaining a crack length ratio, defined as total length of cracks per total length of score, of no greater than 0.1; and (e) exhibits resistance to blocking when stacked at ambient conditions under a load of 0.5 lbs/sq. in. or greater.

These properties are important because they assure that the coating will not crack or contaminate the food in contact with the coating during storage and use of the food carton and the blanks or cartons can be separated by conventional feed systems.

Figure 6:
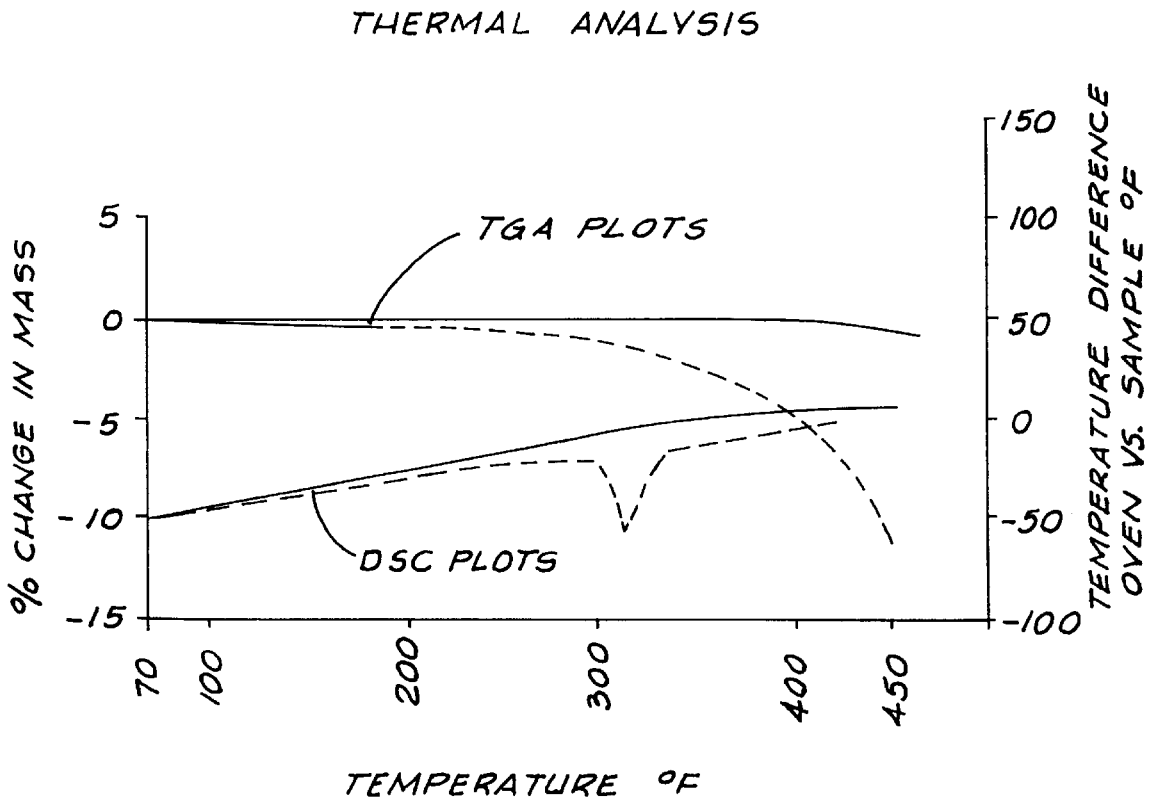
FIG. 6 is a graphical illustration of a thermal analysis of percent changes in mass versus temperature (in °F.) versus temperature differences between the oven and the sample (in °F.).

Representative mass stability of the coating 18 is described in FIG. 6. A Differential Scanning Calorimetry (DSC) plot is a measure of the difference in temperature between the coating sample in an oven plotted against the temperature as it is increased from ambient to 400° F.+. Any endothermic or exothermic event along the plot would represent a physical transition (melting). The solid line represents a coating with the necessary thermal properties for ovenable applications. The dotted line is typical of a coating which could not be considered for these applications because it melts at approximately 325° F.

The Thermal Gravimetric Analysis (TGA) plot, also shown in FIG. 6, is a measure of the weight of the coating sample plotted against temperature. Any significant weight loss, as indicated by the dotted TGA plot, indicates product outgassing. The solid TGA plot is representative of an acceptable coating for the use described. The dotted TGA plot is representative of an unacceptable coating due to significant weight loss at temperatures less than 400° F.

As mentioned above, another essential property of the described coated material, which in most cases directly or incidentally contacts the food, is that the materials do not transfer to the food product during storage or reconstitution. Food substances generally packaged in the cartons described can contain high levels of fats, oils, and sugars. These substances can readily solubilize a coating, given certain conditions, which in turn could be absorbed by the food product.

To assure non-transfer of substances from the package to the food product, an extraction test on the food contact surface may be employed. Coated paperboard may be tested by use of the extraction cell described in the "Official Methods of Analysis of the Association of Official Analytical Chemists," 13th Ed. (1980) sections 21.010–21.015, under "Exposing Flexible Barrier Materials for Extraction." A suitable food simulating solvent for tray applications described would be N-Heptane. The N-Heptane should be a reagent grade, freshly redistilled before use, using only material boiling at 208° F.

The extraction methodology consists of, first, cutting the lid sample to be extracted to a size compatible with the clamping device chosen. Next, the sample to be extracted is placed in the device so that the solvent only contacts the food contact surface. The solvent is then added to the sample holder and placed in an oven for two hours at 150° F.

At the end of the exposure period, the test cell is removed from the oven and the solvent is poured into a clean Pyrex® flask or beaker being sure to rinse the test cell with a small quantity of clean solvent. The food-simulating solvent is evaporated to about 100 millimeters in the container, and transferred to a clean, tared evaporating dish. The flask is washed three times with small portions of the Heptane solvent and the solvent is evaporated to a few millimeters on a hot plate. The last few millimeters should be evaporated in an oven maintained at a temperature of approximately 221° F. The evaporating dish is cooled in a desiccator for 30 minutes.

A chloroform extraction is then performed by adding 50 milliliters of reagent grade chloroform to the residue. The mix is warmed, filtered through a Whatman No. 41 filter paper in a Pyrex® funnel and the filtrate is collected in a clean, tared evaporating dish. The chloroform extraction is then repeated by washing the filter paper with a second portion of chloroform. This filtrate is added to the original filtrate and the total is evaporated down to a few millimeters on a low temperature hot plate. The last few millimeters should be evaporated in an oven maintained at approximately 221° F. The evaporating dish is cooled in a desiccator for 30 minutes and weighed to the nearest 0.1 milligram to get the chloroform-soluble extractives residue.

Table 1 below indicates typical values obtained using this procedure for a water-based copolymer coating having the necessary attributes for the application described herein.

TABLE 1

| Solvent | Time/Temp | Residue (mg/in$^2$) |
|---|---|---|
| N-Heptane | 2 hrs/150° F. | .33 |
| | | .45 |
| | | .27 |
| | | .28 |
| | | .22 |
| | | .24 |

To be assured that there is no appreciable coating transfer to the food product, the chloroform-soluble extractives should not exceed 0.5 mg/in$^2$.

Other properties of the water-based emulsion of the present invention are flexibility, i.e., exhibits crack resistance. Representative flexibility performance of the coating is described in Table 2, on the following page.

TABLE 2

MATERIAL AND SCORING DATA

Board Thickness = .018" (C2S)
Coating A = Acrylic Copolymer (Prior Art)
Coating B = Copolymer Coating 16 (Present Invention)
Coating Weight (Dry) = 2.5# to 7.4#/3,000 ft.$^2$
Scoring Notes: Rule Thickness = .028"
Channel Width = Score #1 - .062"
#2 - .070"
#3 - .078"
#4 - .086"
Rule/Channel Clearance = .000"

TABLE 2-continued

Mineral Oil Evaluation

| Coat Weight #'s/3,000 Ft.$^2$ | Coating | Percent Corn Oil Penetration Score # 1 | 2 | 3 | 4 |
|---|---|---|---|---|---|
| 2.5 | A | 100 | 90 | 75 | 55 |
| 2.5 | B | 25 | 10 | 0 | 0 |
| 3.9 | A | 80 | 65 | 50 | 15 |
| 3.9 | B | 10 | 0 | 0 | 0 |
| 4.9 | A | 40 | 35 | 10 | 5 |
| 4.9 | B | <5 | 0 | 0 | 0 |
| 7.4 | A | 20 | 10 | 5 | <5 |
| 7.4 | B | 0 | 0 | 0 | 0 |

Iodine Evaluation

| Coat Weight #'s/3,000 Ft.$^2$ | Coating | Avg. Crack Size/Crack Coverage Score # 1 | 2 | 3 | 4 |
|---|---|---|---|---|---|
| 2.5 | A | .18"/90% | .03"/80% | .03"/60% | .01"/5% |
| 2.5 | B | .01"/50% | .01"/25% | .01"/5% | ND |
| 3.9 | A | .06"/20% | .06"/20% | .06"/10% | .005"/5% |
| 3.9 | B | .01"/5% | No Data | ND | ND |
| 4.9 | A | .06"/15% | .005"/5% | ND | ND |
| 4.9 | B | No Data (ND) | ND | ND | ND |
| 7.4 | A | .04"/10% | ND | ND | ND |
| 7.4 | B | ND | ND | ND | ND |

To arrive at the information set forth in Table 2, a conventional scoring integrity testing was performed on a conventional Acrylic Copolymer-based Coating A vs the water-soluble Vinyl Acetate Copolymer Coating B, according to the present invention. C2S paperboard was coated with each of the two coatings at a variety of coat weight levels. Samples were prepared through threaded rod draw downs. Samples were conventionally scored with the length of the score running in the cross-direction. Scoring parameters are listed above in Table 2.

Scoring samples were evaluated in two conventional ways. The first conventional method consisted of staining a 1 inch to two inch section of the score with corn oil (at 70° F.) that contained a conventional red dye. The oil was applied over the score for 30 seconds then wiped clean. A one inch section of the score was then examined under a microscope (20 x magnification) and the percent area in which the oil had stained was conventionally determined. The purpose of this test was to predict the amount of food juice penetration during cooking because food juice penetration in the board is detrimental to packaging integrity and causes unsightly staining of the carton.

The second conventional evaluation was performed using iodine to stain the scored areas. This technique made any cracks in the applied coating extremely visible. Cracking on each score was evaluated as to average crack size and coverage (length wise) over a 1 inch score area.

As can be seen from the data in Table 2, Coating B clearly indicates a superior score crack resistance due to reduced food juice penetration and reduced crack size and coverage. A final important property of the water-based emulsion of the present invention is block resistance when blanks or trays are stacked under a load of 0.5 lbs./sq. in. or greater. As mentioned earlier, blanks or trays manufactured using the process of the present invention are delivered to the end user in stacks. Typically, blanks are cased (approximately 1000/ case) or palletized. The pallets are then stacked creating fairly high (0.5 lbs/sq. in.) loads on the bottom layers of blanks. Trays may be "nested" and delivered and shipped in a similar manner. When the trays or blanks are unpacked by the end user they are typically loaded into a mechanical devise which separates the articles and transfers them to a conveyer or sealing device. If the blanks or trays have any attraction to one another, the coating 16 must have the necessary properties which allow for easy separation. As mentioned earlier, this may be achieved through the addition of particles to coating 16 which have a specific gravity between 0.8 and 3.5 and a size range of 5 to 60 microns. Preferably, the particulates are glass, glass beads and/or nylon beads.

Once given the above disclosure, many features, modifications or improvements will become apparent to the skilled artisan. Such features, modifications or improvements are, therefore, considered to be a part of this invention, the scope of which to be determined by the following claims.

What is claimed is:

1. A paperboard food distribution carton, wherein said paperboard carton is consisting essentially of:

a paperboard substrate having a first side with a calendered coating of particulate minerals which provides an outer surface suitable for the printing of graphics and a second side supporting a first continuous coating of a dried, water-based, copolymer emulsion which provides an inner surface suitable for direct food contact, the improvement wherein said dried, water-based, copolymer emulsion further provides vapor barrier properties and allows a heat sealing of a paperboard lid to said food distribution vessel in a covering position over a corresponding vessel fill opening; wherein said dried water-based emulsion is further characterized as being mass stable below 400° F., can be tacked bonded at 250° F. or greater, has chloroform-soluble extractives not exceeding 0.5 mg/in.$^2$ of food contact surface when exposed to a food simulating solvent at 150° F. for two hours, is flexible enough to withstand conventional scoring in the cross direction with a 2 point male rule and a 0.062" channel while sustaining a crack length ratio of no greater than 0.1, provides slip and block resistance when stacked under a load of 0.5 lbs/sq. in. or greater, is applied to said second side at a coat weight of 6 to 12 dry pounds per 3000 sq. ft. and includes insoluble particles having a specific gravity of between 0.8 and 3.5.

2. The carton, as in claim 1, wherein said second side is coated with a second calendered coating of particulate minerals such that said second calendered coating is located substantially between said paperboard substrate and said first coating of said water-based copolymer emulsion.

3. The carton, as in claim 1, wherein said first coating of said water-based copolymer emulsion is applied substantially over said second calendered coating with a coat weight of 2 to 8 dry pounds per 3000 sq. ft.

4. The carton, as in claim 1, wherein said water-based coating is further comprised of:

insoluble particles in a size range of 5 to 60 microns.

5. The carton, as in claim 1, wherein said insoluble particles are further comprised of:

glass.

6. The carton, as in claim 1, wherein said insoluble particles are further comprised of:

glass beads.

7. The carton, as in claim 1, wherein said insoluble particles are further comprised of:

nylon beads.

8. The carton, as in claim 4, wherein said insoluble particles are further comprised of:

glass.

9. The carton, as in claim 4, wherein said insoluble particles are further comprised of:

glass beads.

10. The carton, as in claim 4, wherein said insoluble particles are further comprised of:

nylon beads.

* * * * *